US008311432B2

(12) United States Patent
Miyagawa

(10) Patent No.: US 8,311,432 B2
(45) Date of Patent: Nov. 13, 2012

(54) IMAGE HEATING APPARATUS

(75) Inventor: Daisuke Miyagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 187 days.

(21) Appl. No.: 12/559,930

(22) Filed: Sep. 15, 2009

(65) Prior Publication Data

US 2010/0003043 A1 Jan. 7, 2010

Related U.S. Application Data

(63) Continuation of application No. PCT/JP2009/058727, filed on Apr. 28, 2009.

(30) Foreign Application Priority Data

Apr. 30, 2008 (JP) ..... 2008-118532
Apr. 22, 2009 (JP) ..... 2009-103837

(51) Int. Cl.
*G03G 15/20* (2006.01)

(52) U.S. Cl. ..... 399/69; 399/70

(58) Field of Classification Search ..... 399/67–70
See application file for complete search history.

(56) References Cited

U.S. PATENT DOCUMENTS 5,572,306 A 11/1996 Goto et al.
6,111,230 A * 8/2000 Cao et al. ..... 219/501
6,615,003 B2 9/2003 Nakayama
7,295,789 B2 11/2007 Inukai
7,511,727 B2 * 3/2009 Nishida ..... 347/156
2003/0020968 A1 1/2003 Dan
2004/0190923 A1 9/2004 Inukai

FOREIGN PATENT DOCUMENTS

EP 1 632 822 A2 3/2006
JP 03-163483 7/1991
JP 3-163483 A 7/1991
JP 06-332338 12/1994
JP 6-332338 A 12/1994
JP 10-186937 7/1998
JP 2002-296954 10/2002
JP 2004-138839 5/2004

OTHER PUBLICATIONS

International Search Report and Written Opinion of the International Search Report of PCT/JP2009/058727, dated Jun. 2, 2009.

(Continued)

*Primary Examiner* — Hoang Ngo
(74) *Attorney, Agent, or Firm* — Fitzpatrick, Cella, Harper & Scinto

(57) ABSTRACT

An image forming apparatus prevents the occurrence of the combinations of output wave numbers which are ineffective to suppress flicker in a case where a set heater temperature is significantly reduced. If the set temperature is significantly reduced from 200° C. to 130° C., for example, so that the reduced temperature does not require current to be applied to a ceramic heater, which can occur at the time of starting reverse conveyance of the recording sheet in the double-faced printing mode, temperature control is temporarily suspended and the output wave number of power controlled by a controller is varied to 0 waves based on the previously set combinations of 12, 10, 4 and 0 waves, for example, if the output wave number is varied from 12.

9 Claims, 12 Drawing Sheets

OTHER PUBLICATIONS

Japanese version of the May 22, 2009 Written Opinion of the International Searching Authority (PCT/ISA/237), an English-language version of Nov. 11, 2010 Notification Concerning Transmittal of Copy of International Preliminary Report on Patentability, an English-language version of the Dec. 13, 2010 International Preliminary Report on Patentability (PCT/IB/373), an English-language version of the Dec. 23, 2010 Notification of Transmittal of Copies of Translation of the International Preliminary Report on Patentability, and an English translation.

Chinese Office Action dated Sep. 1, 2011, in corresponding Chinese Application No. 20098010815.6, and English-language translation thereof.

Korean Office Action dated Sep. 28, 2011, in corresponding Korean Application No. 10-2010-7018110.

Russian Office Action dated Dec. 7, 2011, in counterpart Russian Application No. 2010148786/28(070444) and English-language translation thereof.

* cited by examiner

IMAGE HEATING APPARATUS

This application is a continuation of International Application No. PCT/JP2009/058727, filed Apr. 28, 2009, which claims the benefit of Japanese Patent Application Nos. 2008-118532, filed Apr. 30, 2008 and 2009-103837, filed Apr. 22, 2009.

BACKGROUND OF THE INVENTION

1. Field of the Invention

The present invention relates to an image heating apparatus suitably used as a heat fixing apparatus mounted on an image forming apparatus such as a copier and laser beam printer.

2. Related Background Art

The conventional electrophotographic type of image forming apparatus uses a heat-roller type of heat-fixing device with a halogen heater as a heat source, or a film-heating heat-fixing device using a ceramic heater as a heat source, as means of thermally fixing a toner image on a recording material.

A temperature detection element such as a thermistor is provided on the heat-fixing device. The temperature detection element detects a temperature of the heat-fixing device to vary an electric current applied to a heater, adjusting the temperature of the heater to a target temperature. The temperature is controlled by using a proportional plus integral (PI) control or a proportional plus integral plus derivative control (PID) control. The power is controlled by using a wave number control. The wave number control is a power control method to control the power supplied to a heater by defining one wave by a half wave of an alternating-current waveform and controlling the wave number applied to the heater out of a predetermined wave number (hereinafter referred to as basic wave number).

FIG. 8 is a timing chart illustrating the case where the temperature is controlled by the PI control to substantially change a set temperature at a time. Reference characters 8*a*, 8*b* and 8*c* denote a set temperature, a supplied power and flicker at this point respectively. If the set temperature of 8*a* is substantially changed from a temperature A to a temperature B, the electric power supplied to the heater suddenly changes as indicated by 8*b*. This steeply varies the power supply voltage, which sometimes generates flicker as indicated by 8*c*. Flicker is a phenomenon in which a voltage is periodically dropped due to the impedance of indoor wiring when current flowing into a load is periodically changed to cause flicker of an incandescent lamp connected to the same indoor wiring to which a load apparatus is also connected. In general, the steeper the variation in power supply voltage, the greater the degree of the flicker.

Japanese Patent Application Laid-Open No. H10-186937 discloses two methods of suppressing flicker which causes a problem when the set temperature is substantially changed from the temperature A to the temperature B. A first method stepwise changes the set temperature of the heater little by little. A second method gradually changes the temperature of the heater while electric power supplied to the heater is limited to a constant for a given length of time.

FIG. 9 is a timing chart in the case where the set temperature is stepwise changed from the temperature A to the temperature B. Reference characters 9*a*, 9*b*, 9*c* and 9*d* in the figure denote a set temperature, the temperature of the heater, a supplied power and flicker at this point respectively.

FIG. 10 is a timing chart in the case where the supplied power is stepwise changed. Reference characters 10*a*, 10*b* and 10*c* in the figure denote a set temperature, a supplied power and flicker at this point respectively.

The electric power supplied to the heater depends on the difference between the set temperature and the temperature detected by the temperature detection element for detecting the temperature of the heater. For this reason, a waveform of a current flowing into the heater also depends on the difference between the set temperature and the temperature detected by the temperature detection element for detecting the temperature of the heater. As illustrated in FIG. 9, even if the set temperature is constant, the temperature of the heater causes a ripple, so that, even if the set temperature is constant, there is varied a difference between the set temperature and the temperature detected by the temperature detection element for detecting the temperature of the heater. For this reason, if the set temperature is stepwise changed like the first method, and even if the set temperature is within a period of time, the output wave-number within the period is uncertain, so that the waveform of current flowing through the heater is variously changed. Human eyes are most sensitive to flicker of approximately 8.8 Hz. Therefore, the smaller the flicker is than 8.8 Hz or the larger the flicker is than 8.8 Hz, the lower the sensitivity, forming an electrification (current application) pattern producing a variation in voltage around a frequency high in visual sensitivity, depending on the combination of the output wave-numbers, which has sometimes not been very effective in suppressing flicker.

Also in the second method, there are various combinations of change in the output wave-numbers related to variations in the power supply voltage and disturbance, forming the electrification pattern producing variation in voltage around a frequency high in visual sensitivity, depending on the combination of the output wave-numbers, which has sometimes not been very effective in suppressing flicker.

FIG. 3 is a chart illustrating an electrification pattern of each level in the wave number control with a basic wave number of 14 and an output wave number of an 8-step level. The half wave indicated by oblique lines in FIG. 3 represents a voltage to be applied. FIGS. 11A and 11B illustrate examples in which a flicker suppressing effect is varied with a combination of output wave numbers in the wave number control with the output wave number being the electrification pattern illustrated in FIG. 3. Reference characters 11*a* and 11*c* represent how output wave numbers are varied. Reference characters 11*b* and 11*d* represent flicker in the output waves represented by reference characters 11*a* and 11*b*, respectively.

When the output wave number is varied from 8 waves to 0 waves, a combination of the output wave numbers in the case where the output wave numbers of 8, 6, 4, 2 and 0 are sequentially varied (refer to 11*a* in FIG. 11A) causes a change in voltage whose frequency is higher in visual sensitivity than a combination of the output wave numbers in the case where the output wave numbers of 8, 4 and 0 are sequentially varied (refer to 11*c* in FIG. 11B). For this reason, the peak value of flicker in the case where the output wave numbers of 8, 4 and 0 are sequentially varied (refer to lid in FIG. 11B) is lower than the peak value of flicker in the case where the output wave numbers of 8, 6, 4, 2 and 0 are sequentially varied (refer to 11*b* in FIG. 11A) when the output wave numbers are varied from 8 to 0. The pattern of an electric power supplied to the heater in 11*a* is varied more gently than that in 11*c*. However, the pattern in 11*a* is sometimes inferior to that in 11*c* in the level of flicker.

SUMMARY OF THE INVENTION

The purpose of the present invention, in view of the above problems, is to provide an image heating apparatus capable of suppressing flicker.

Another purpose of the present invention is to provide an image heating apparatus for heating a recording material bearing an image including: a heater; a temperature detection element for detecting the temperature of the heater; and a power control part for controlling electric power supplied from a power supply to the heater, the power control part controlling an output wave number supplied to the heater to control the electric power supplied to the heater; wherein, a period during which the electric power supplied to the heater is controlled includes a first period during which the output wave number is controlled so that the detected temperature of the temperature detection element maintains a set temperature and a second period following the first period and the waveform of current flowing into the heater is predetermined during the second period.

A further purpose of the present invention will be apparent from the following detailed description when the same is read with reference to the accompanying drawings.

DETAILED DESCRIPTION OF THE INVENTION

An exemplary embodiment for carrying out the present invention is described more in detail below using an embodiment. The following description is made with reference to drawings.

Configuration of Image Forming Apparatus

First Embodiment

Figure 1:
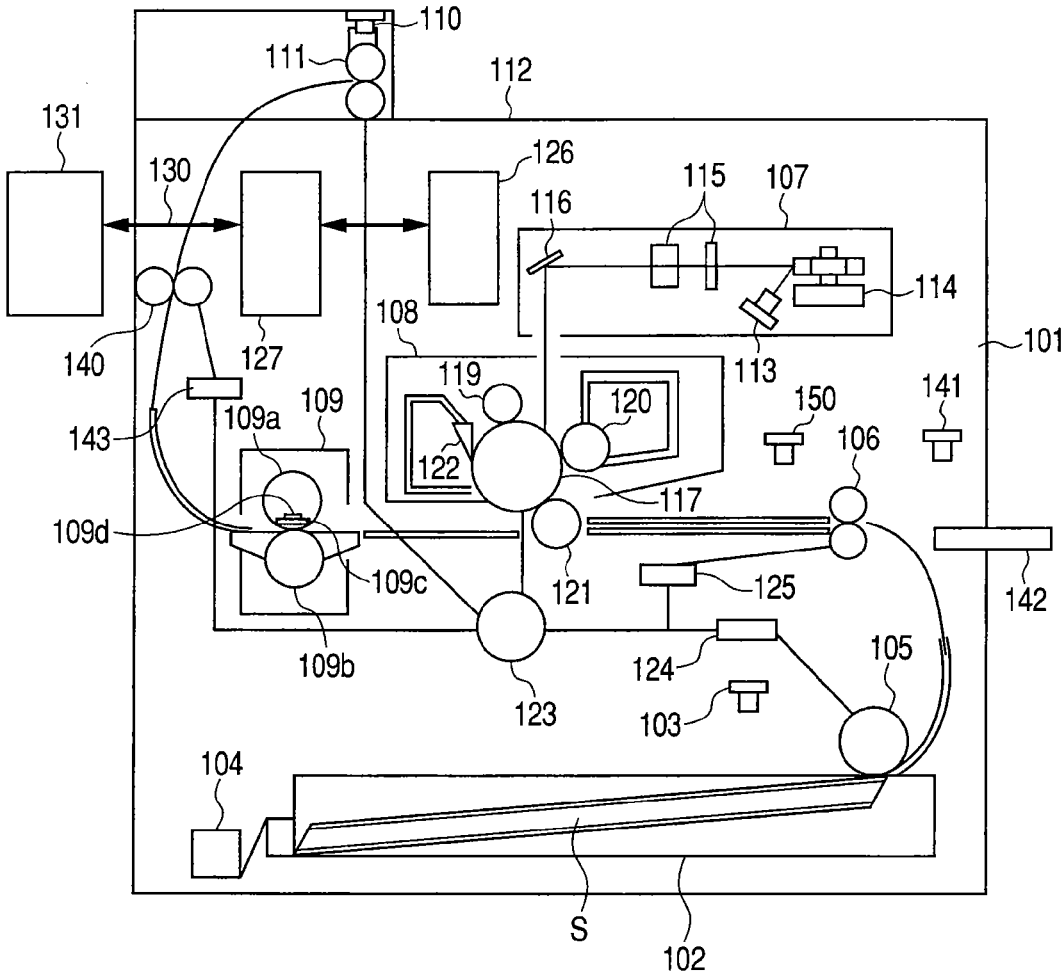
FIG. 1 is a schematic diagram of an image forming apparatus on which an image heating apparatus is mounted as a fixing apparatus.

FIG. 1 is a schematic diagram of an image forming apparatus using an electrophotographic process in the embodiment of the present invention and exemplifies a laser beam printer, for example.

A laser beam printer main body 101 (hereinafter referred to as a main body 101) is configured as follows. The main body 101 includes a cassette 102 for housing a recording material S and a cassette sensor 103 for detecting whether the recording material S exists in the cassette 102. The main body 101 further includes a cassette size sensor 104 for detecting the size of the recording material S in the cassette 102 and a paper feeding roller 105 for feeding the recording material S from the cassette 102. A registration roller pair 106 for synchronously conveying the recording material S is provided downstream of the paper feeding roller 105. An image forming part 108 for forming a toner image on the recording material S based on laser beams from a laser scanner part 107 is provided downstream of the registration roller pair 106. A heat-fixing device 109 (thermal fixing unit) for thermally fixing the toner image formed on the recording material S is further provided downstream of the image forming part 108. A top sensor 150 for detecting the fed recording material is provided upstream of the heat-fixing device 109. Downstream of the heat-fixing device 109, there is provided a discharge-sheet sensor 110 for detecting a conveyance state of a discharge sheet part, a discharge sheet roller 111 for discharging the recording material S and a stack tray 112 on which the recording material S in which a recording process is completed is stacked.

The laser scanner part 107 is configured as follows. The laser scanner part 107 includes a laser unit 113 for emitting laser light modulated based on a video signal (video signal VDO) transmitted by an external apparatus 131 described later. The laser scanner part 107 further includes a polygon motor 114, an imaging lens 115 and a reflecting mirror 116 which scan laser light from the laser unit 113 on a photosensitive drum 117 described later.

The image forming part 108 includes the photosensitive drum 117, a primary charging roller 119, a developer 120, a transfer charging roller 121 and a cleaner 122, which are required for a publicly known electrophotographic process.

The heat-fixing device (image heating apparatus) 109 is equipped with a fixing film (endless belt) 109*a*, a pressure roller 109*b*, a ceramic heater 109*c* including a heating element provided inside the fixing film 109*a* and a thermistor 109*d* as a temperature detection unit (temperature detection element) for detecting the temperature of the ceramic heater 109*c*.

A main motor 123 provides a driving force for the paper feeding roller 105 through a paper feeding solenoid 124, for the registration roller pair 106 through a registration clutch 125 and for a conveyance roller pair 140 through a conveyance clutch 143. The main motor 123 further provides a driving force for each unit of the image forming part 108 including the photosensitive drum 117, the heat-fixing device 109 and the discharge sheet roller 111.

In addition, a manually-feeding paper sensor 141 detects whether a sheet of paper is inserted into a manual paper feeding inlet 142.

An engine control unit 126 includes a power supply circuit, a high voltage circuit, a CPU and a peripheral circuit. The engine control unit 126 controls the laser scanner part 107, a high voltage circuit part (the image forming part 108), the electrophotographic process by the heat-fixing device 109 and the conveyance of the recording material S in the main body 101.

A video controller 127 is connected to the external apparatus 131 such as a personal computer through a general-purpose interface (USB) 130. The video controller 127 develops video information sent from the general-purpose interface into bit data and sends the bit data as a video signal VDO to the engine control unit 126.

<Block Diagram of Heater Driving Control System>

Figure 2:
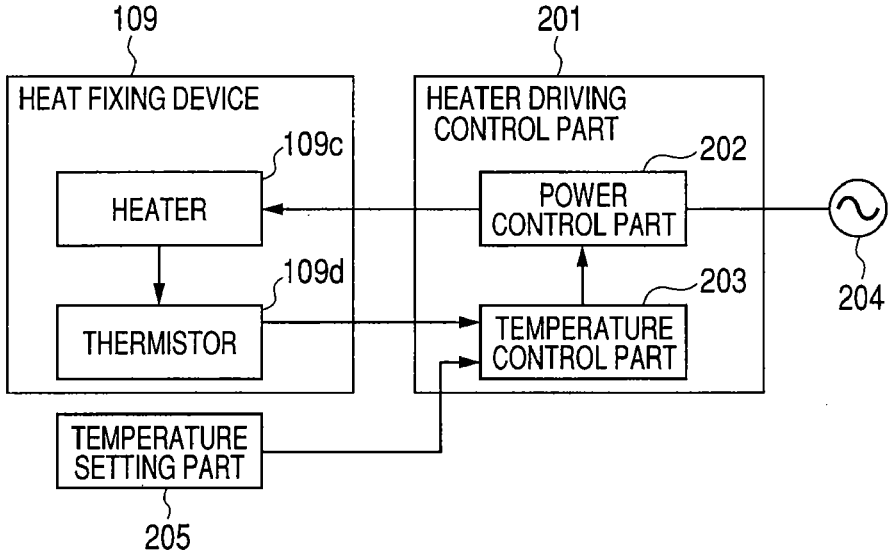
FIG. 2 is a block diagram of a heater driving control part in a first to a third embodiment.

FIG. 2 is a block diagram of a heater driving control system. A heater driving control part 201 (heater driving control unit) includes a power control part 202 (power control unit) and a temperature control part 203 (temperature control unit). The power control part 202 controls the output of electric power from an electric power supplying part 204 (electric power supplying part) to the ceramic heater 109*c* (simply denoted by the term "heater" in the figure) of the heat-fixing device 109 by wave number control based on information from the temperature control part 203. The temperature control part 203 compares temperature information of the ceramic heater 109*c* input from the thermistor 109*d* with temperature information set by a temperature setting part 205 (temperature setting unit), causes the PI control to determine the level of the output wave number and outputs the result to the power control part 202.

(Wave Number Control in the Present Embodiment)

Figure 3:
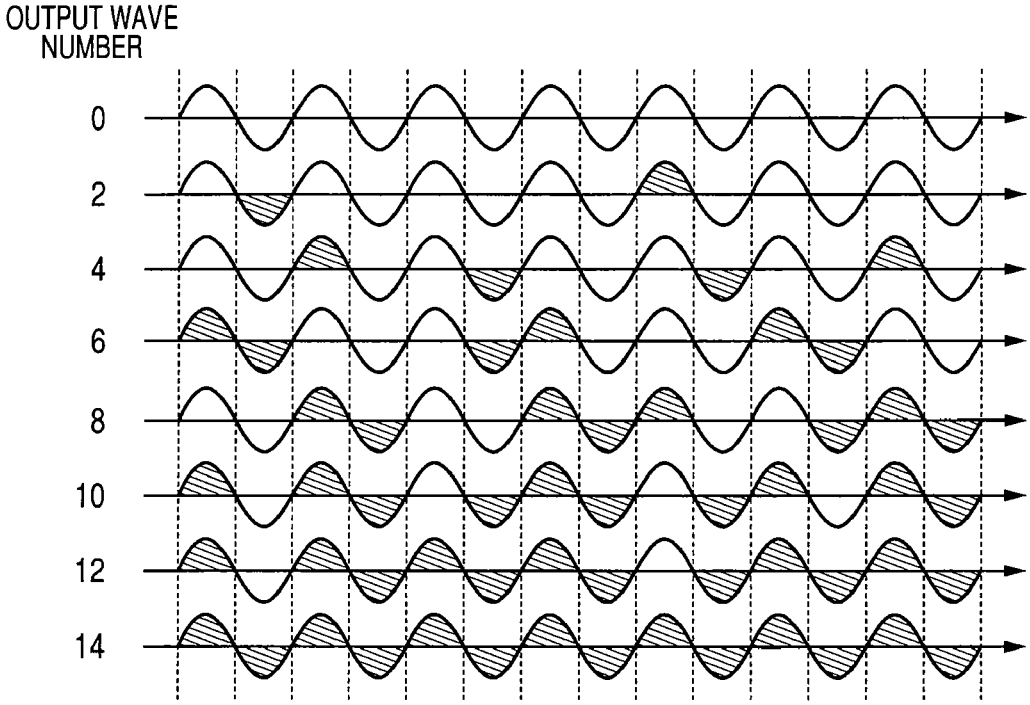
FIG. 3 is an electrification pattern of an output wave number in a first to a third embodiment.

The wave number control in the present embodiment performs power control by the output wave number with a basic wave number of 14 and the output wave number of an 8-step level illustrated in FIG. 3. The half wave indicated by oblique lines in FIG. 3 represents a voltage applied to the ceramic heater 109*c*.

Combinations of change in the output wave number which are effective in suppressing flicker are previously evaluated at the stage of designing the apparatus.

Figure 12:
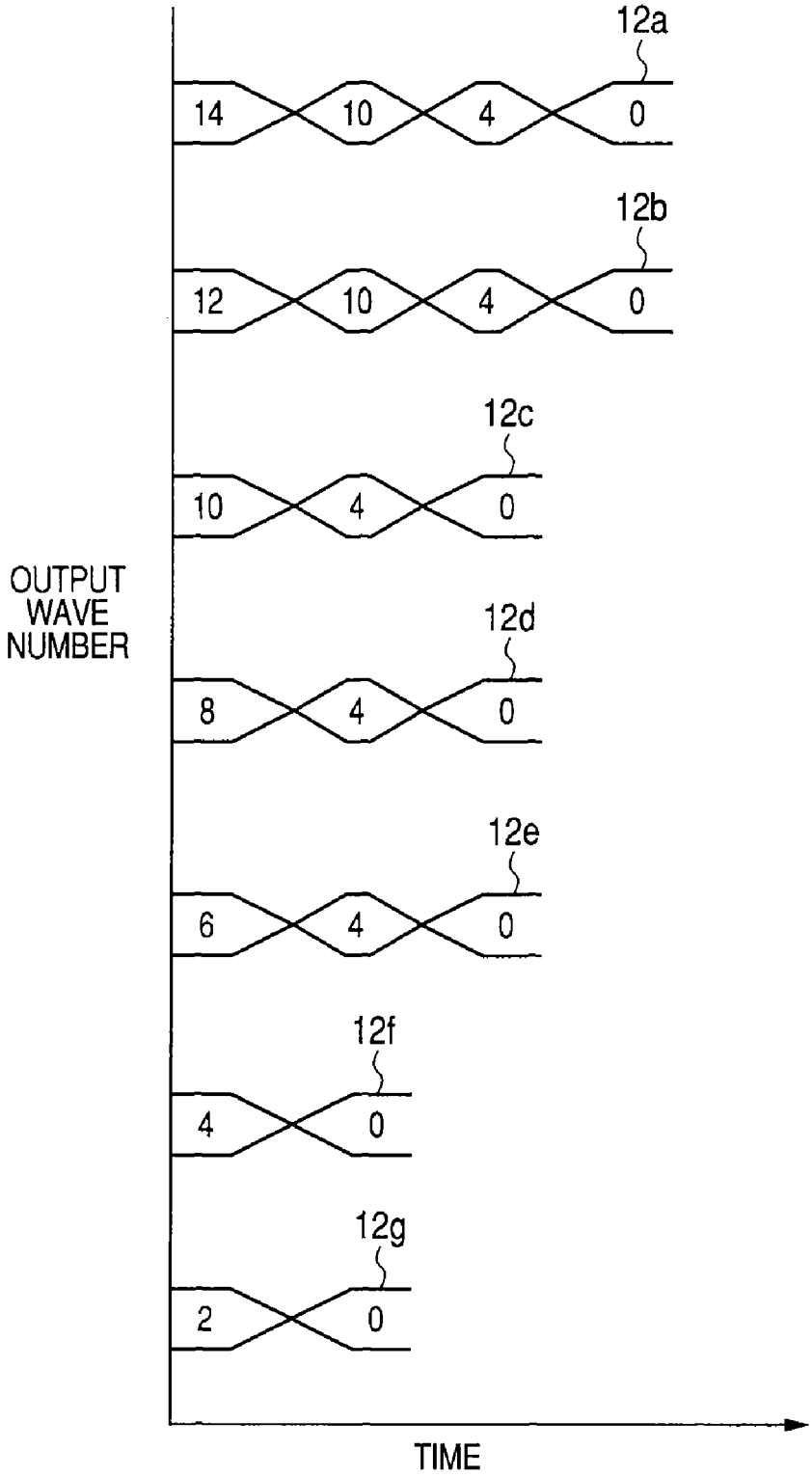
FIG. 12 is a chart illustrating combinations of changes in output wave numbers in the first and the second embodiments.

When the output wave number is varied from 8 waves to 0 waves in the case where the waveform of the pattern illustrated in FIG. 3 is used, varying 8, 4 and 0 waves is more effective in suppressing flicker than sequentially varying 8, 6, 4, 2 and 0 waves in the order. On the other hand, when the output wave number is varied from 12 waves to 0 waves, varying 12, 10, 4 and 0 waves is more effective in suppressing flicker than sequentially varying 12, 6 and 0 waves in the order. FIG. 5*d* illustrates a flicker level 5*d* in the case where the output wave numbers of 12, 10, 4 and 0 waves are sequentially varied in this order and a flicker level 5*e* in the case where the output wave numbers of 12, 6 and 0 waves are sequentially varied in this order. The flicker level 5*e* is higher in peak value than the flicker level 5*d*, which means that the flicker level 5*e* is smaller in a flicker suppression effect than the flicker level 5*d*. Thus, it is required to previously set a combination of output wave numbers effective in suppressing flicker in not only the case where the output wave number is varied from 8 waves to 0 waves, but also other cases (from 12 waves to 0 waves, for example). FIG. 12 illustrates combinations of output wave numbers which are effective in suppressing flicker. In FIG. 12, 12*a* indicates the variation of the output wave numbers from 14 waves to 0 waves, 12*b* indicates the variation of the output wave numbers from 12 waves to 0 waves, 12*c* indicates the variation of the output wave numbers from 10 waves to 0 waves, 12*d* indicates the variation of the output wave numbers from 8 waves to 0 waves, 12*e* indicates the variation of the output wave numbers from 6 waves to 0 waves, 12*f* indicates the variation of the output wave numbers from 4 waves to 0 waves and 12*g* indicates the variation of the output wave numbers from 2 waves to 0 waves. Thus, the combinations of wave numbers effective in suppressing flicker, i.e., the combinations of waveforms effective in suppressing flicker, are previously evaluated at the stage of designing the apparatus.

Figure 4:
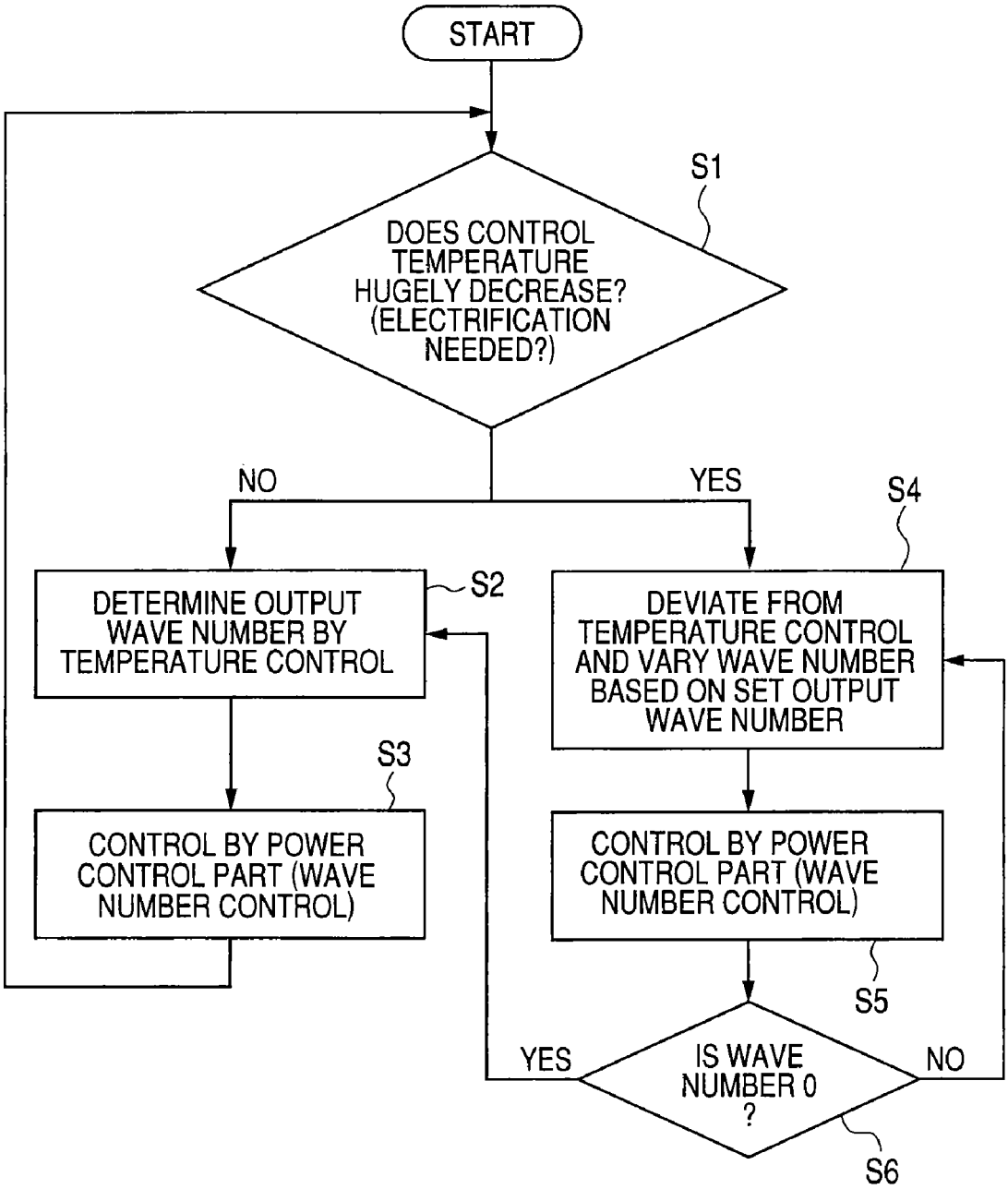
FIG. 4 is a flow chart in the first embodiment.

FIG. 4 is a flow chart illustrating the operation of the apparatus of the present embodiment.

In step S1, a determination is made as to whether the set temperature needs to be significantly reduced to such a temperature that current does not need to be applied to the ceramic heater 109*c* (or, whether this is the case where the set temperature needs to be significantly reduced or not). If the set temperature is not significantly reduced, the process proceeds to step S2 and an output wave number is determined by a normal temperature control of the temperature control part 203. In step S3, the power control part 202 controls the electric power applied to the ceramic heater 109*c*. In other words, the processes from steps S1 to S3 correspond to a first period during which the output wave number is controlled so that the detected temperature of the temperature detection element maintains the set temperature.

In step S1, if the set temperature is reduced to such a temperature that current does not need to be applied, the process proceeds to step S4 to temporarily suspend the process in which the temperature of the heat-fixing device 109 is controlled by the temperature control part 203 and vary the output wave number based on the previously set combinations of the output wave numbers. In step S5, the power control part 202 controls the application of current to the ceramic heater 109*c* based on the above result. In step S6, a determination is made as to whether the output wave number is 0. If the output wave number is not 0, the process returns to step S4. The output wave number is varied based on the previously set combinations of the output wave numbers until the output wave number becomes 0. In other words, the processes from steps S1 to S4, S5 and S6 correspond to a second period following the first period. The waveform of current flowing into the heater during the second period is predetermined. As illustrated in FIG. 12, the previously set output wave number is changed irrespective of the temperature of the heater in the second period. Since the previously set output wave number is changed, the waveform of current flowing into the heater during the second period is predetermined according to the output wave number set at the end of the first period.

If the output wave number becomes 0 (S6, Yes), the process proceeds to step S2 to return to a normal temperature-control (the first period).

At the time of reversely conveying the recording material S after a surface toner image is fixed at the set temperature of 200° C., for example, it takes a longer time (an interval of 3 seconds, for example) for the recording material whose one face was subjected to a fixing process to reach again the fixing part in a double-faced printing mode than in a continuous single-faced printing mode, so that the application of current to the heater is sometimes cut off during the period of the interval to suppress power consumption. For suppressing flicker that is liable to occur at the time of cutting off the application of current to the heater, the apparatus of the present embodiment provides the aforementioned second period after the first period during which control is performed so as to maintain a heater temperature of 200° C., cutting off the application of current to the heater through the second period. Incidentally, in the present embodiment, temperature is set to 130° C. to cut off the application of current to the heater (the output wave number is made equal to 0 waves). The temperature of the heater does not need to be reduced to 130° C.

The heater driving control part 201 performs the following control using such a configuration at the time of reverse conveyance in a double-faced printing mode.

Figure 5:
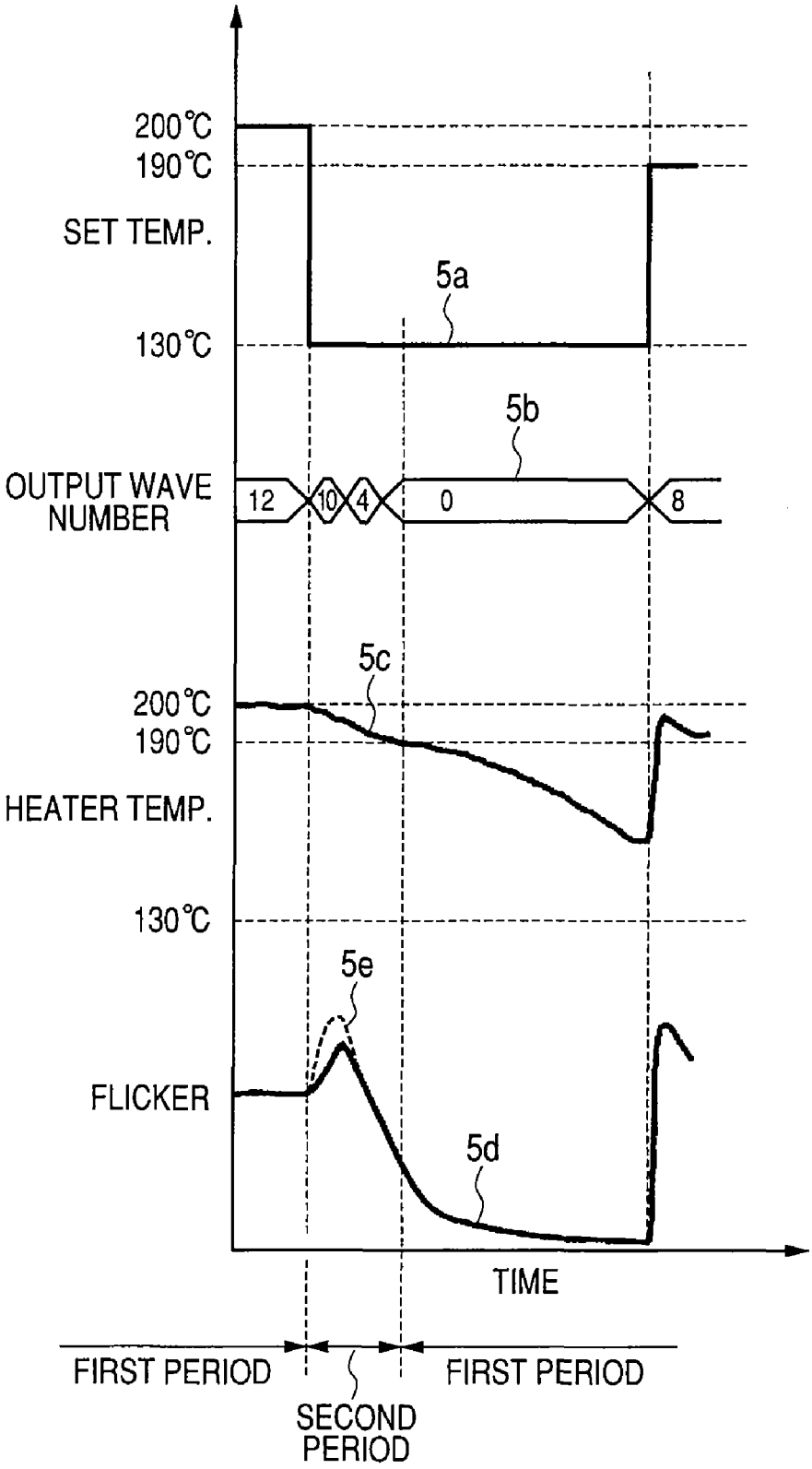
FIG. 5 is a timing chart in the first embodiment.

FIG. 5 is a schematic timing chart in the present embodiment. In the figure, there are denoted the set temperature 5*a*, the output wave number 5*b*, the heater temperature 5*c* and flicker 5*d*. The figure also shows a flicker level 5*e* in the case where the output wave numbers of 12, 6 and 0 waves are varied in this order.

The temperature is set to 200° C. while a surface toner image is being fixed in the double-faced printing mode. The temperature of the ceramic heater 109*c* is detected by the thermistor 109*d*. Comparing the temperature detected by the thermistor 109*d* with the temperature (200° C.) set by the temperature setting part 205 causes the temperature control part 203 to determine the output wave number. The power control part 202 controls the output of electric power supplied to the ceramic heater 109*c* based on the above result so that the temperature of the ceramic heater 109*c* is maintained at 200° C. (the first period).

The set temperature is significantly reduced from 200° C. to 130° C. as indicated by 5*a* at the time of starting the reverse conveyance in the double-faced printing mode. For that purpose, the process is temporarily suspended in which the temperature of the heat-fixing device 109 is controlled by the temperature control part 203 and the output wave number is varied to 0 based on the previously set combinations of the output wave numbers of, for example, 12, 10, 4 and 0 waves as indicated by 5*b* if the output wave number set at the end of the first period is 12 waves (the second period). The process returns to the normal temperature control (the first period) after the output wave number reaches 0. In the present embodiment, the temperature of the heater does not fall to 130° C. even when the output wave number reaches 0 to terminate the second period, so that the output wave number maintains 0 waves until the period of the interval is ended. Thus, varying the output wave number based on the previously set combinations of the output wave numbers does not generate the combinations of the output wave numbers of 12, 6 and 0 waves to be varied in this order, causing current with the predetermined waveform to flow into the heater, which produces an effect of suppressing flicker as indicated by 5*d*.

The set temperature is raised to 190° C. at a predetermined timing to fix the toner image on the other face of the recording material S. Since the temperature of the recording material intruding into the fixing part at the time of fixation on the other surface (a second face) is higher than that at the time of fixation on one surface (a first face), the temperature at the time of fixation on the other surface is set lower than the temperature of 200° C. at the time of fixation on one surface.

Thus, setting the temperature varies the output wave number based on a specific combination in the case where the set temperature is reduced to such a temperature that current does not need to be applied to the ceramic heater 109*c* at the time of starting the reverse conveyance in the double-faced printing mode, for example. This prevents the occurrence of the combinations of the output wave numbers which are not very effective in suppressing flicker.

Second Embodiment

In the first embodiment, the set temperature is reduced to such a temperature that current does not need to be applied to the ceramic heater 109*c* and the output wave number is reduced to 0 waves. In the present embodiment, a case is considered in which the set temperature is reduced, but not reduced to such an extent that the output wave number is reduced to 0 waves. Also in such a case, the process (the first period) performed by the temperature control part 203 is temporarily suspended and the output wave number is stepwise reduced based on the previously set combinations of the output wave numbers, thereby preventing the occurrence of the combinations of the output wave numbers which are not very effective in suppressing flicker. Incidentally, the present embodiment is the same as the first embodiment with respect to FIGS. 1 to 3, so that the description thereof is omitted. The same structural elements as those in the first embodiment are described using the same reference numerals and characters.

<Wave Number Control in the Present Embodiment>

Figure 6:
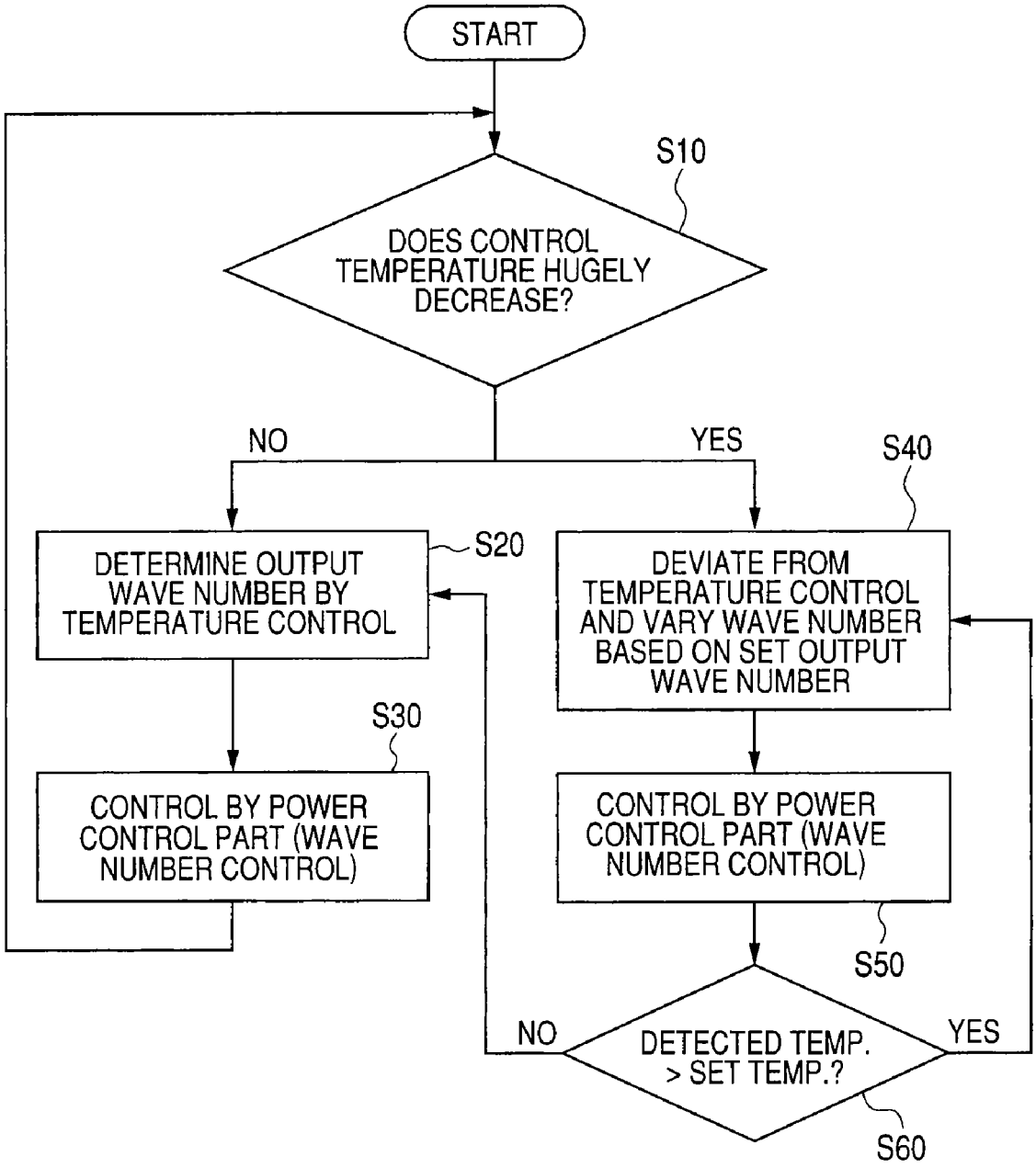
FIG. 6 is a flow chart in the second embodiment.

FIG. 6 is a flow chart of the present embodiment.

In step S10, a determination is made as to whether the set temperature needs to be reduced. If the set temperature does not need to be reduced, the process proceeds to step S20 and an output wave number is determined by a temperature control of the temperature control part 203. In step S30, the power control part 202 controls the electric power applied to the ceramic heater 109*c*. The processes from steps S10 to S30 correspond to the first period during which the output wave number is controlled so that the detected temperature of the temperature detection element maintains the set temperature.

If the set temperature is reduced in step S10, the process proceeds to step S40 to temporarily suspend the process performed by the temperature control part 203 and vary the output wave number based on the previously set combinations of the output wave numbers. In step S50, the power control part 202 supplies electric power to the ceramic heater 109*c* based on the above result. In step S60, a determination is made as to whether the temperature of the ceramic heater 109*c* detected by the thermistor 109*d* is higher than the reduced set-temperature. If the detected temperature is higher than the set temperature, the process returns to step S40. This varies the output wave number based on the previously set combinations of the output wave numbers according to the output wave number set at the end of the first period until the detected temperature of the ceramic heater 109*c* reaches the reduced set-temperature. The processes from steps S10 to S40, S50 and S60 correspond to a second period following the first period. The waveform of current flowing into the heater during the second period is predetermined. As illustrated in FIG. 12, the previously set output wave number is changed irrespective of the temperature of the heater in the second period. Since the previously set output wave number is changed, the waveform of current flowing into the heater during the second period is predetermined according to the output wave number set at the end of the first period.

In step S60, if the detected temperature of the ceramic heater 109*c* becomes equal to or less than the set temperature, process proceeds to step S20 to return to a normal temperature control.

In the continuous single-faced printing mode, the greater the number of printing papers, the warmer the entire heat-fixing device 109. For this reason, the set temperature in the first period is reduced by 10° C. from 200° C. to 190° C. at the 40th print and subsequent prints, for example. The wave number control in the second period in the present embodiment is carried out in such a case, for example.

Figure 7:
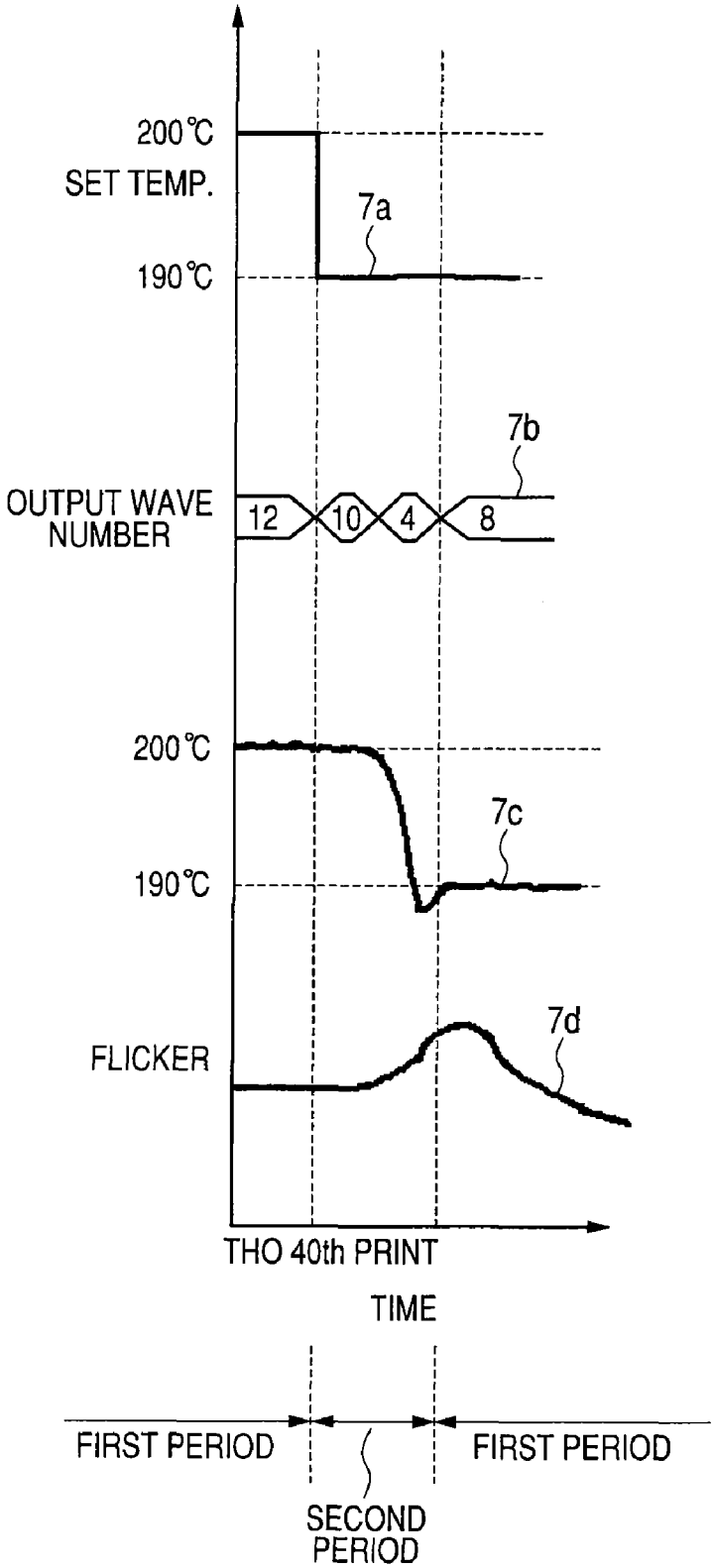
FIG. 7 is a timing chart in the second embodiment.
Figure 8:
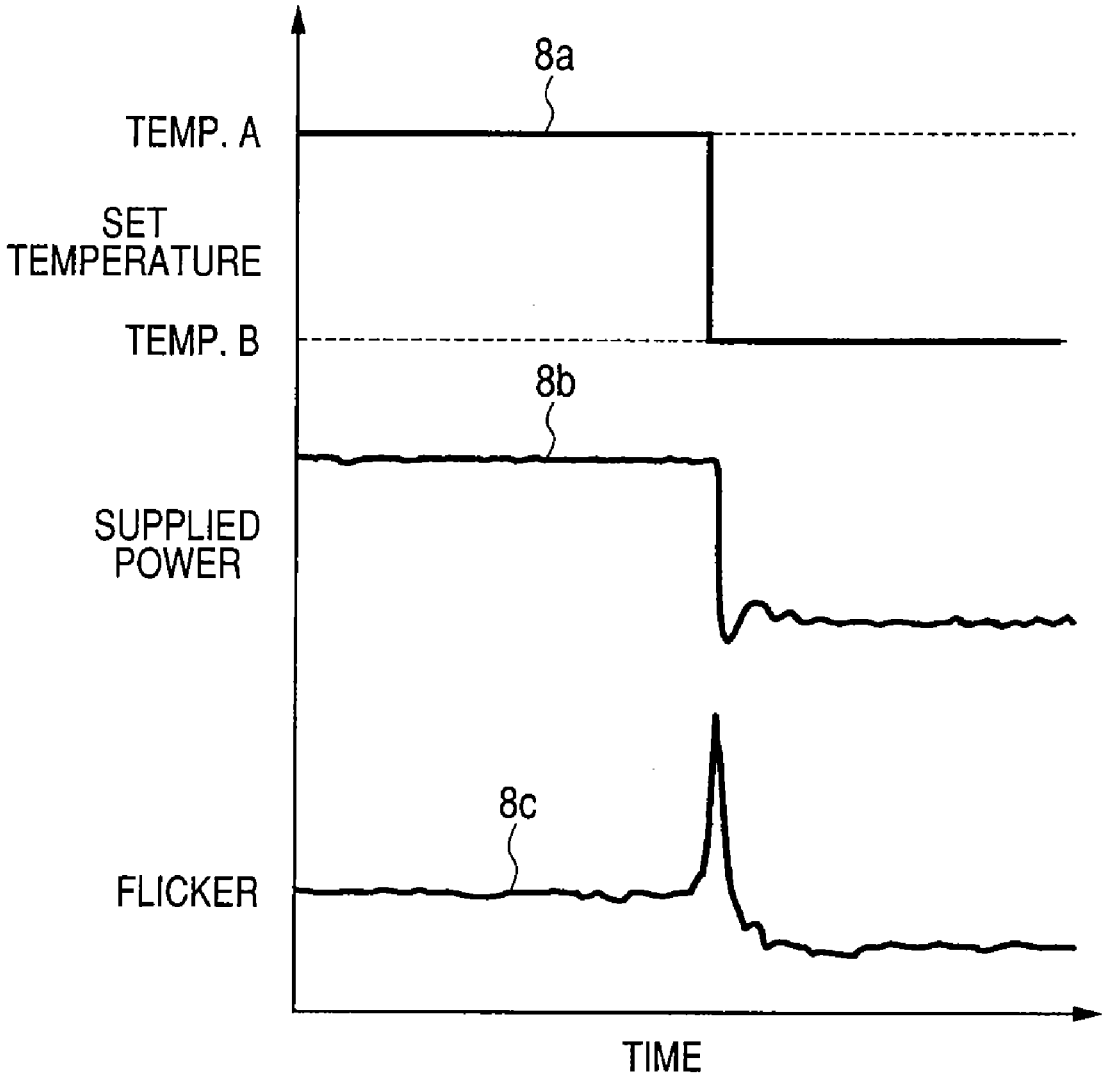
FIG. 8 is a timing chart in a conventional example.
Figure 9:
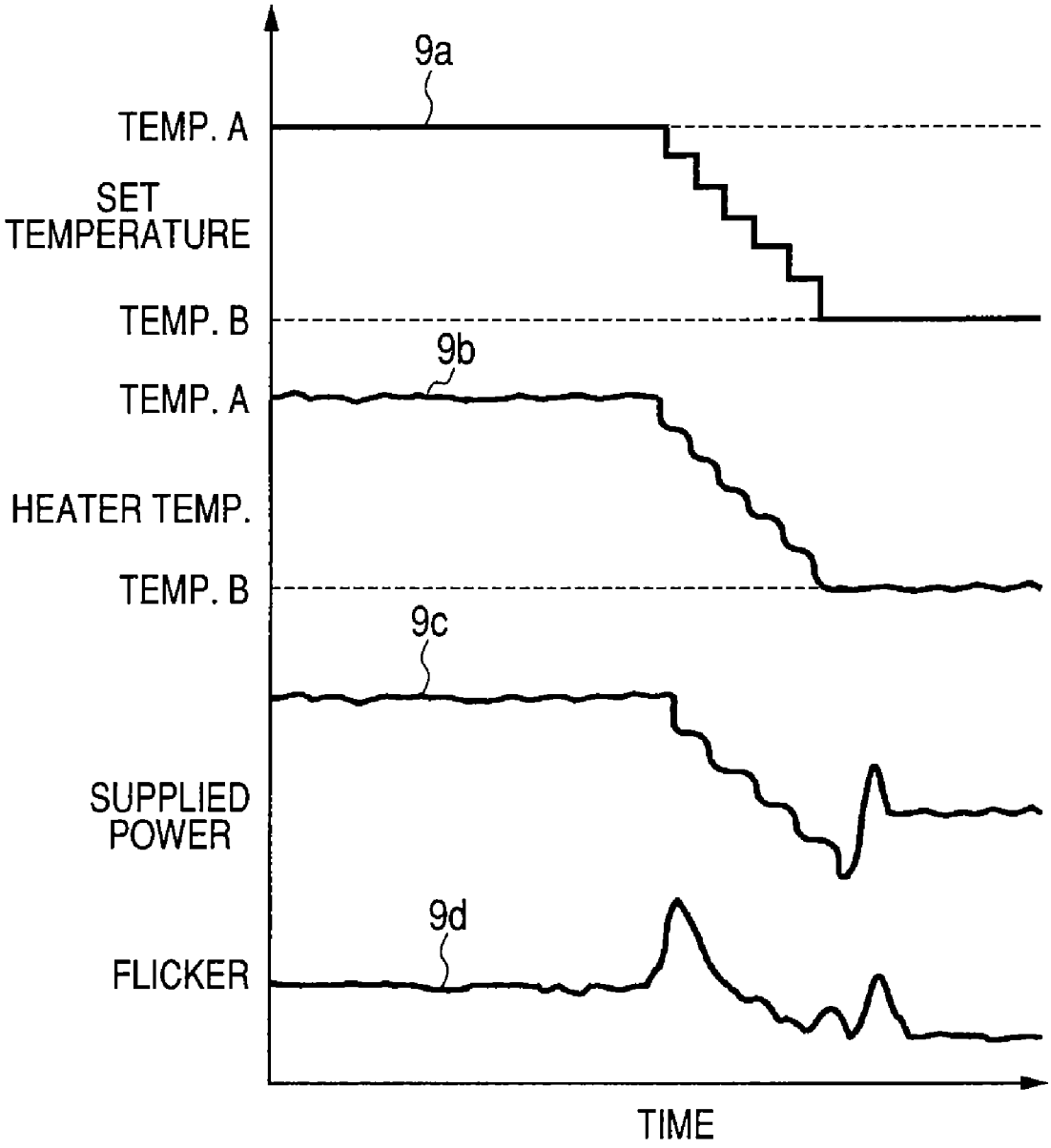
FIG. 9 is a timing chart in a conventional example.
Figure 10:
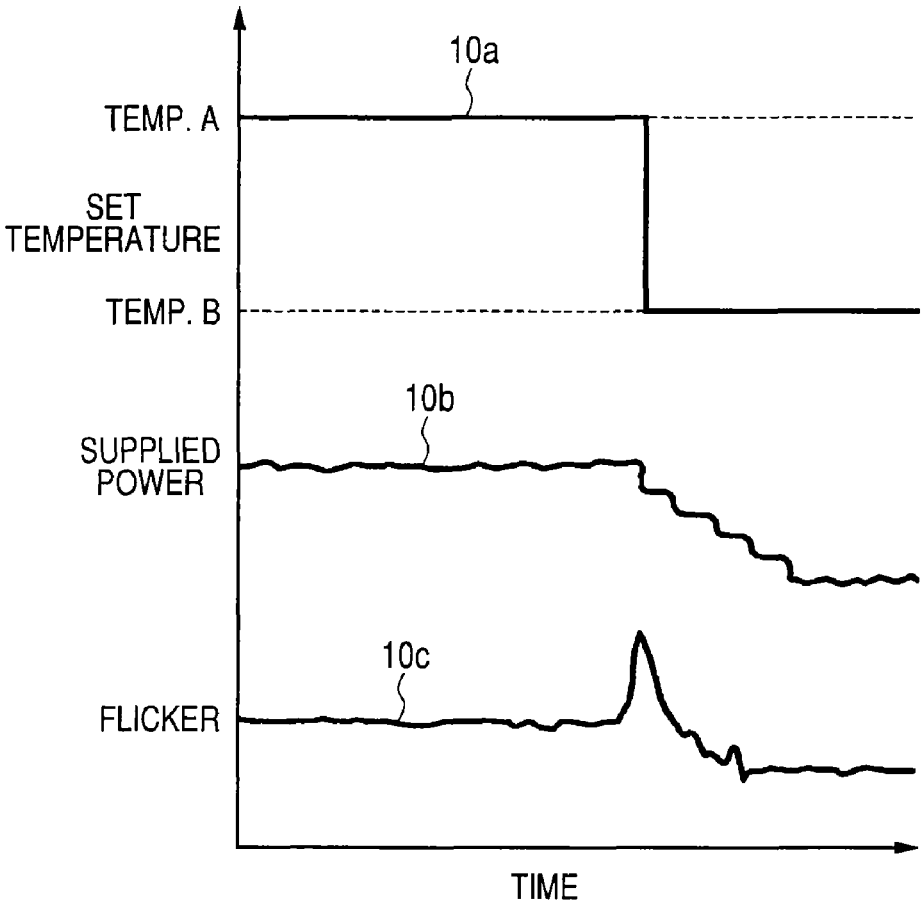
FIG. 10 is a timing chart in a conventional example.
Figure 11A:
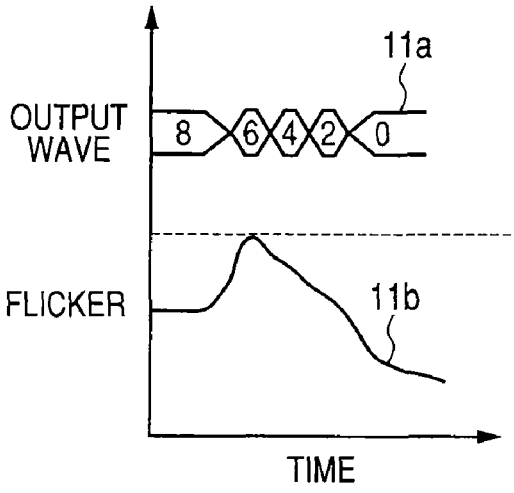
FIGS. 11A and 11B are charts representing a relationship between a combination of output wave numbers and flicker in a conventional example.
Figure 11B:
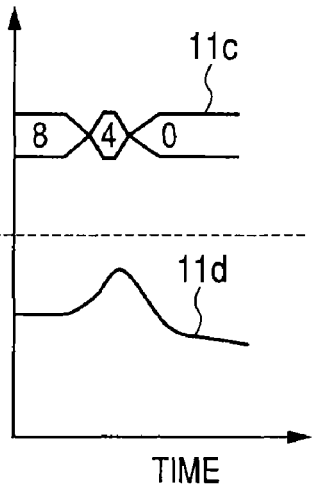

FIG. 7 is a schematic timing chart of the present embodiment. In the figure, there are denoted the set temperature 7*a*, the output wave number 7*b*, the heater temperature 7*c* and flicker 7*d*.

In the continuous single-faced printing mode, as indicated by 7*a*, the set temperature is reduced from 200° C. to 190° C. when the number of prints reaches 40. In such a case, the process performed by the temperature control part 203 is temporarily suspended and current is applied by the output wave number of 10 waves based on the combinations of the output wave numbers previously set according to the output wave number set at the end of the first period if the output wave number is varied from 12 as indicated by 7*b*. At this point, the detected temperature is still 190° C. or higher, so that current is applied by the output wave number of 4 waves, following 10 waves, previously set as its combination with 10 waves. If the temperature of the ceramic heater 109*c* is detected at 190° C., the process returns to the normal temperature control (the first period). Thus, varying the output wave number based on the previously set combinations of the output wave numbers enables the effect of suppressing flicker to be obtained as indicated by 7*d*.

The setting in the above manner varies the output wave number based on a specific combination of the output wave numbers in the case where the set temperature is lowered after several prints are made in the normal continuous printing mode, preventing the occurrence of the combinations of the output wave numbers which are not very effective in suppressing flicker (i.e., a waveform less effective in suppressing flicker).

Third Embodiment

The first embodiment describes the cutting off of the application of current to the heater. The second embodiment describes the lowering of the set temperature. In the present embodiment, the set temperature is elevated. Also, in such a case, the process performed by the temperature control part 203 is temporarily suspended and the output wave number is stepwise increased based on the previously set combinations of the output wave numbers, thereby setting the waveform of current supplied to the heater to a previously set waveform. This prevents electric power from being supplied to the heater using an electrification pattern which is not very effective in suppressing flicker. The present embodiment conceives of the case where the temperature of the heater is increased from the interval period of double-faced printing to the execution of the fixing process for the second face in the second embodiment.

(Wave Number Control in the Present Embodiment)

The present embodiment also uses patterns of eight-stage output wave numbers illustrated in FIG. 3 in the first period. If the output wave number set at the end of the first period is 4 waves, it is more effective in suppressing flicker to increase the output wave number from 4 waves to 10 waves than to increase the output wave number from 4 waves to 6 waves or 8 waves. The optimum combinations of the output wave numbers are previously evaluated at the apparatus designing stage to prepare for the case where the second period starts at wave numbers except 4 wave numbers.

Figure 13:
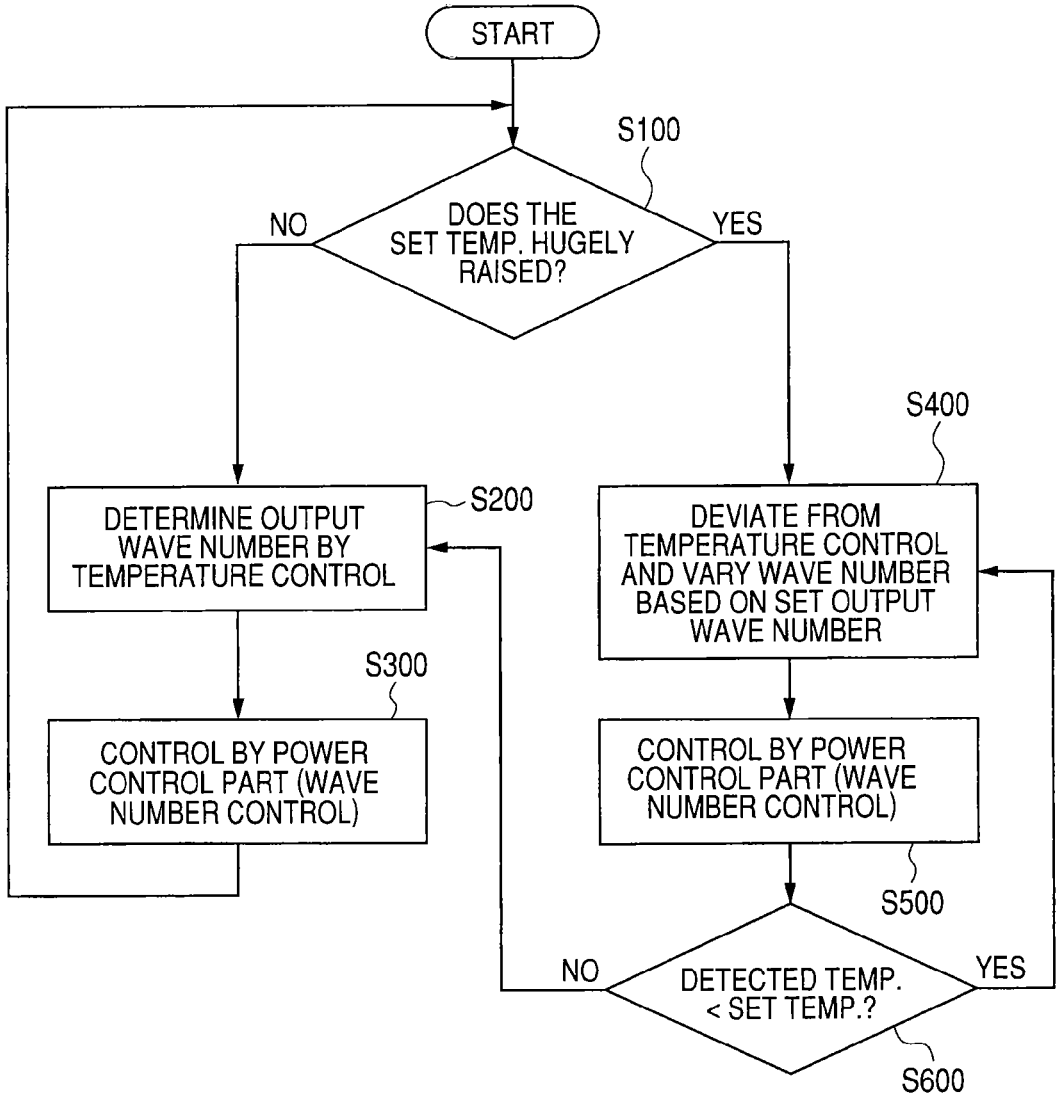
FIG. 13 is a flow chart in the third embodiment.

FIG. 13 is a flow chart of the present embodiment. In step S100, a determination is made as to whether the set temperature needs to be increased. If the set temperature does not need to be increased, the process proceeds to step S200 and an output wave number is determined by a temperature control of the temperature control part 203. In step S300, the power control part 202 controls the electric power applied to the ceramic heater 109*c*. The processes from steps S100 to S300 correspond to the first period during which the output wave number is controlled so that the detected temperature of the temperature detection element maintains the set temperature.

If the set temperature is increased in step S100, the process proceeds to step S400 to temporarily suspend the process performed by the temperature control part 203 and vary the output wave number based on the previously set combinations of the output wave numbers. In step S500, the power control part 202 applies electric power to the ceramic heater 109*c* based on the above result. In step S600, a determination is made as to whether the temperature of the ceramic heater 109*c* detected by the thermistor 109*d* is lower than the increased set-temperature. If the detected temperature is lower than the set temperature, the process returns to step S400. This varies the output wave number based on the combinations of the output wave numbers previously set according to the output wave number immediately before the temporal suspension of the temperature control until the detected temperature of the ceramic heater 109*c* reaches the increased set-temperature. In step S600, if the detected temperature of the ceramic heater 109*c* is increased to the set temperature or above, the process proceeds to step S200 to return to a normal temperature control (the first period). The processes from steps S100 to S400, S500 and S600 correspond to a second period following the first period. The waveform of current flowing into the heater during the second period is predetermined. In the second period, the previously set output wave number is changed irrespective of the temperature of the heater. Since the previously set output wave number is changed, the waveform of current flowing into the heater during the second period is predetermined according to the output wave number set at the end of the first period.

Figure 14:
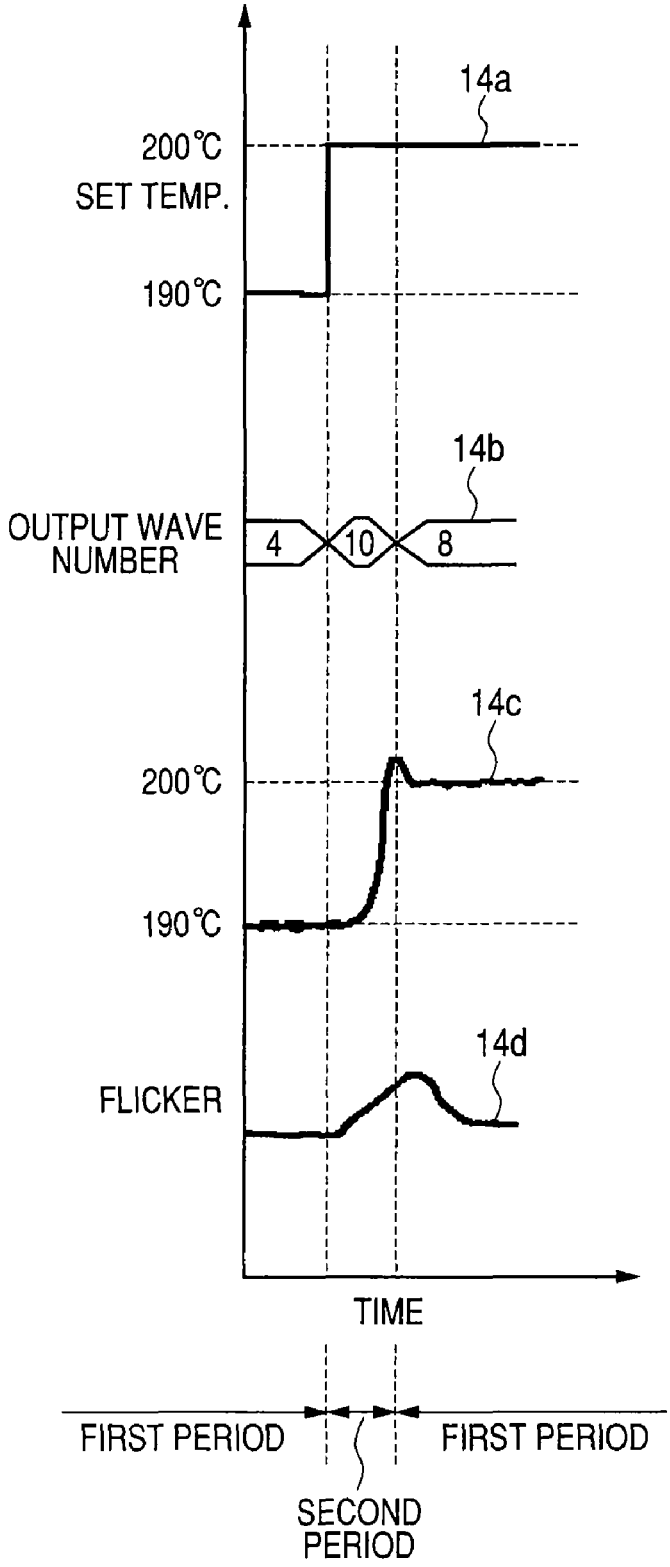
FIG. 14 is a timing chart in the third embodiment.

FIG. 14 is a schematic timing chart of the present embodiment. In the figure, there are denoted the set temperature 14*a*, the output wave number 14*b*, the heater temperature 14*c* and flicker 14*d*. In the double-faced continuous printing mode, as indicated by 14*a*, the set temperature is increased from 190° C. to 200° C. when printing is performed on one face of the recording material S after printing is performed on the other face thereof. In such a case, the process performed by the temperature control part 203 is temporarily suspended and current is applied by the output wave number of 10 waves previously set as its combination with 4 waves if the output wave number is varied from 4 waves, as indicated by 14*b*, for example, based on the combinations of the output wave numbers previously set according to the output wave number immediately before the temporal suspension of the temperature control. If the temperature of the ceramic heater 109*c* is detected at 190° C., the process returns to the normal temperature control (the first period). Thus, varying the output wave number based on the previously set combinations of the output wave numbers enables the effect of suppressing flicker to be obtained. The temperature setting in the above manner varies the output wave number based on a specific combination of the output wave numbers in the case where the set temperature is increased to perform printing on one face of the recording material S after performing printing on the other face thereof in the double-faced continuous printing mode, preventing the occurrence of the combinations of the output wave numbers which are not very effective in suppressing flicker.

Incidentally, a relationship between the pattern of the output wave number and flicker in the present invention is changed depending on the configuration of the image forming apparatus and not limited to the combinations illustrated in the embodiments.

The present invention is not limited to a film-heat heating apparatus, and is even more effectively applicable to an image heating apparatus which includes a heater, an endless belt with the inner face of which the heater contacts, and a pressure roller forming a nip part with the heater through the endless belt, and heats a recording material bearing an image while conveying the material pinched by the nip part.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is to claim a priority based on Japanese Patent Application No. 2008-118532, filed on Apr. 30, 2008 and Japanese Patent Application No. 2009-103837, filed on Apr. 22, 2009 and the disclosure of which is incorporated herein by reference.

What is claimed is:

1. An image heating apparatus that heats a recording material bearing an image, comprising:

a heater;

a temperature detection element that detects a temperature of said heater; and a power control part that controls electric power supplied from a power supply to said heater, said power control part controlling an output wave number supplied to the heater to control the electric power supplied to the heater, wherein a period for controlling the electric power supplied to the heater includes a first period during which the output wave number is controlled so that the detected temperature of the temperature detection element maintains a set temperature and a second period following the first period during which the waveform of current flowing into the heater is predetermined.

2. An image heating apparatus according to claim 1, wherein the waveform of current flowing into said heater during the second period is determined according to the output wave number set at the end of the first period.

3. An image heating apparatus according to claim 1, further comprising:

an endless belt whose inner face contacts the heater; and a pressure roller forming a nip part with the heater through the endless belt, wherein, the recording material bearing the image is heated while being conveyed to and pinched by the nip part.

4. An image heating apparatus that heats a recording material bearing an image, comprising:

a heater;

a temperature detection element that detects a temperature of said heater; and a power control part that controls electric power supplied from a power supply to said heater, said power control part controlling an output wave number supplied to the heater to control the electric power supplied to the heater, wherein a period for controlling the electric power supplied to the heater includes a first period during which the output wave number is controlled so that the detected temperature of the temperature detection element maintains a set temperature and a second period following the first period during which the waveform of current flowing into the heater is specified.

5. An image heating apparatus according to claim 4, wherein the waveform of current flowing into said heater during the second period is specified according to the output wave number set at the end of the first period.

6. An image heating apparatus according to claim 4, during the first period, said power control part chooses an output wave number among a plurality of levels of the output wave numbers, according to the detected temperature of the temperature detection element, wherein the specified waveform of current flowing into said heater during the second period is defined by a specified output wave number among the plurality of levels of the output wave numbers.

7. An image heating apparatus according to claim 4, wherein the second period is a period from a time when the set temperature is switched from a first set temperature to a second set temperature to a time when the first period during which the output wave number is controlled so that the detected temperature of the temperature detection element maintains the second set temperature starts.

8. An image heating apparatus according to claim 4, wherein the second period is determined at a time when the set temperature is switched from a temperature set as the set temperature during which the recording material is heated at a heating nip portion to another temperature set as the set temperature in an interval period during which the recording material is reheated at a heating nip portion.

9. An image heating apparatus according to claim 4, further comprising:

an endless belt whose inner face contacts the heater; and a pressure roller forming a nip part with the heater through the endless belt, wherein, the recording material bearing the image is heated while being conveyed to and pinched by the nip part.

* * * * *